US009464568B2

(12) United States Patent
Jones

(10) Patent No.: US 9,464,568 B2
(45) Date of Patent: Oct. 11, 2016

(54) POWER EQUIPMENT WITH THROTTLE RELEASE ACTUATOR

(71) Applicant: Husqvarna AB, Huskvarna (SE)

(72) Inventor: Chad Jones, Mount Holly, NC (US)

(73) Assignee: HUSQVARNA AB, Huskvarna (SE)

( * ) Notice: Subject to any disclaimer, the term of this patent is extended or adjusted under 35 U.S.C. 154(b) by 45 days.

(21) Appl. No.: 14/231,847

(22) Filed: Apr. 1, 2014

(65) Prior Publication Data

US 2014/0290621 A1 Oct. 2, 2014

Related U.S. Application Data

(60) Provisional application No. 61/807,421, filed on Apr. 2, 2013.

(51) Int. Cl.

| | |
|---|---|
| ***F02M 35/00*** | (2006.01) |
| ***F02B 63/02*** | (2006.01) |
| ***F02M 3/00*** | (2006.01) |
| ***F02M 3/045*** | (2006.01) |
| *F02D 11/00* | (2006.01) |
| *F02B 3/06* | (2006.01) |
| *F02D 11/10* | (2006.01) |
| *F02D 9/10* | (2006.01) |
| *F02D 1/10* | (2006.01) |

(52) U.S. Cl.

CPC ..... *F02B 63/02* (2013.01); *F02M 3/00* (2013.01); *F02M 3/045* (2013.01); *F02B 3/06* (2013.01); *F02D 1/10* (2013.01); *F02D 9/1065* (2013.01); *F02D 11/00* (2013.01); *F02D 11/10* (2013.01); *Y10T 29/49863* (2015.01)

(58) Field of Classification Search

CPC ..... F02B 3/06; F02D 1/10; F02D 9/1065; F02D 11/00; F02D 11/10

USPC ..... 123/343

See application file for complete search history.

(56) References Cited

U.S. PATENT DOCUMENTS

| | | | | |
|---|---|---|---|---|
| 2,982,275 A * | 5/1961 | Doman et al. | ..... | 123/198 DC |
| 3,044,751 A * | 7/1962 | Sarto | ..... | F02M 1/08 261/23.2 |
| 6,848,405 B1 * | 2/2005 | Dow et al. | ..... | 123/179.18 |

* cited by examiner

*Primary Examiner* — Lindsay Low
*Assistant Examiner* — Charles Brauch
(74) *Attorney, Agent, or Firm* — Nelson Mullins Riley & Scarborough LLP

(57) ABSTRACT

An outdoor power tool may include an engine, a carburetor configured to provide a fuel and air mixture to the engine based on operation of a throttle assembly, a selector and a throttle release actuator. The selector may be operably coupled to the throttle assembly to control a position of the throttle assembly in a selected one of a plurality of throttle positions. One of the throttle positions may be an idle position and each of the other throttle positions may be selectable by an operator via manual positioning of the selector. The throttle release actuator may be configured to return the selector from any one of the throttle positions to the idle position responsive to operator actuation of the throttle release actuator.

20 Claims, 6 Drawing Sheets

POWER EQUIPMENT WITH THROTTLE RELEASE ACTUATOR

CROSS-REFERENCE TO RELATED APPLICATIONS

Figure 1:
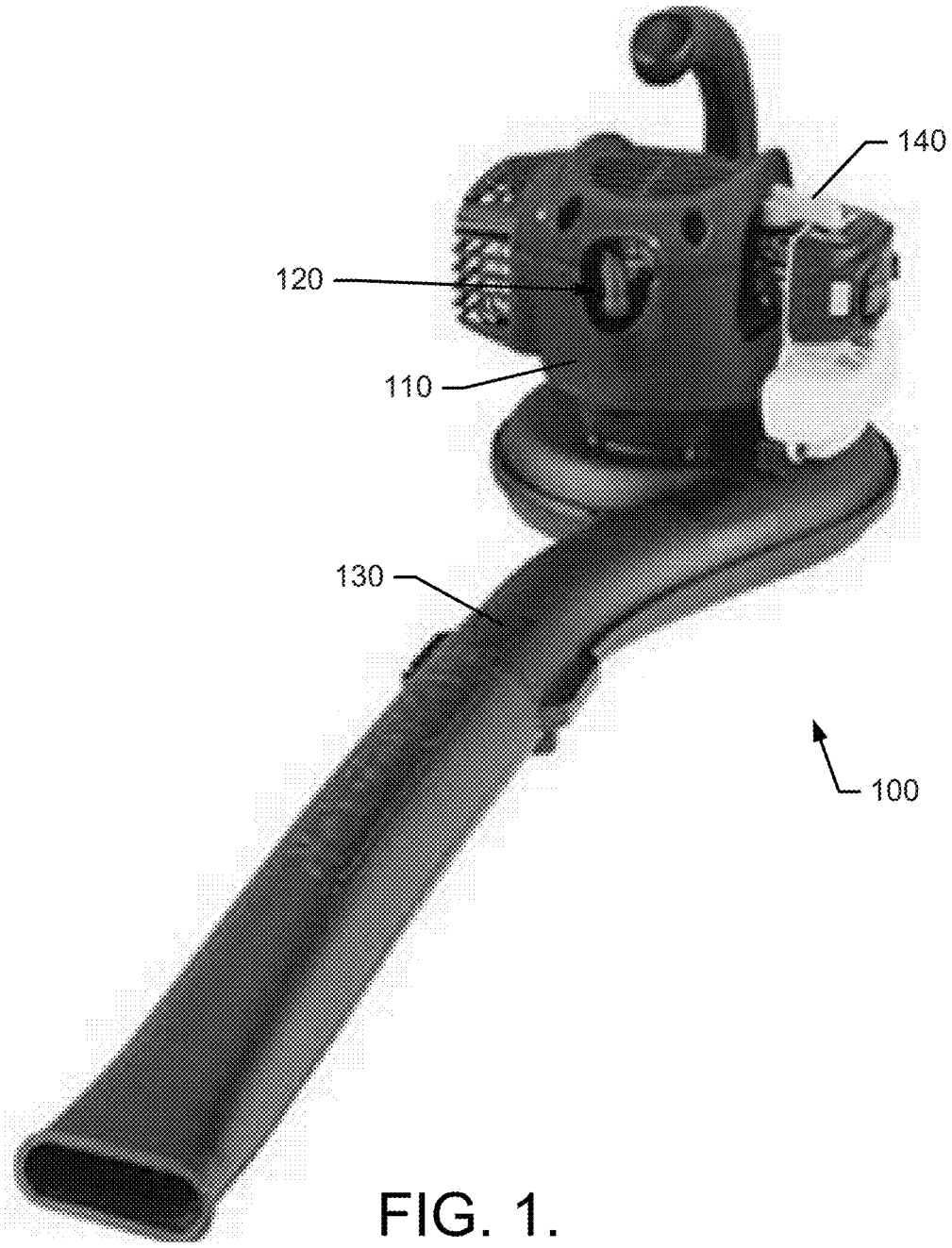

This application claims the benefit of U.S. Provisional Application No. 61/807,421 filed on Apr. 2, 2013, the entire contents of which are hereby incorporated herein by reference.

TECHNICAL FIELD

Example embodiments generally relate to outdoor power equipment and, more particularly, relate to outdoor power equipment devices that employ carburetors in connection with internal combustion engines.

BACKGROUND

Outdoor power equipment includes such devices as mowers, trimmers, edgers, chainsaws, blowers and the like. These devices are often used to perform tasks that inherently require the devices to be mobile. Accordingly, these devices are typically made to be relatively robust and capable of handling difficult work in hostile environments, while balancing the requirement for mobility.

Powering such devices could be accomplished in any number of ways. However, for outdoor power equipment that is intended to be handheld, size and weight become important considerations. Thus, one common source of power for handheld outdoor power equipment has been the internal combustion engine due to its ability to provide ample power in a relatively small package. Internal combustion engines for handheld outdoor power equipment typically employ engines that blend air and fuel in a carburetor. The carburetor is a well known device, and employs an internal venturi to enable airflow provided into the engine to draw fuel into the airstream. In many cases, the flow of air and fuel into the engine can be controlled using a throttle valve.

In some engines, the position of the throttle valve may be adjusted by an operator employing some form of trigger mechanism, usually coupled to the throttle valve via a cable. The trigger mechanism may be provided on a handle of the machine so that it can be operated by a hand or fingers of the operator. In such an engine, when the trigger mechanism is not depressed, the engine is typically enabled to return to an idle condition. However, not all engines are necessarily constructed to employ trigger mechanisms. Some engines employ a series of discrete throttle valve positions that are manually selectable to increase the simplicity of design. In such designs, a lever or selector is typically adjusted manually by the operator to one of the throttle valve positions. Movement between each of these positions therefore requires the operator to manually select a desired position, including the idle position.

BRIEF SUMMARY OF SOME EXAMPLES

Some example embodiments may therefore provide a throttle release actuator that is configured to enable a user to easily return the engine to an idle state. In this regard, a lever or selector may be provided that is enabled to be manually moved to any one of a number of selectable throttle positions. However, the operator may be further enabled to trigger an automatic return to the idle position from any one of the selectable throttle positions via a single return mechanism in the form of the throttle release actuator.

According to an example embodiment, an outdoor power tool may be provided. The outdoor power tool may include an engine, a carburetor configured to provide a fuel and air mixture to the engine based on operation of a throttle assembly, a selector and a throttle release actuator. The selector may be operably coupled to the throttle assembly to control a position of the throttle assembly in a selected one of a plurality of throttle positions. One of the throttle positions may be an idle position and each of the other throttle positions may be selectable by an operator via manual positioning of the selector. The throttle release actuator may be configured to return the selector from any one of the throttle positions to the idle position responsive to operator actuation of the throttle release actuator.

In accordance with another example embodiment, a method of assembling a throttle release actuator is provided. The method may include an operation of providing a support assembly proximate to a shaft of a throttle assembly. The shaft may operably couple a selector to a throttle valve of the throttle assembly for selection of a position of the throttle valve based on manual positioning of the selector in a selected one of a plurality of throttle positions. The method may further include an operation of providing a biasing assembly into a portion of the selector. The biasing assembly may be configured to return the selector to an idle position from any one of the throttle positions responsive to operation of the throttle release actuator. The method may further include an operation of inserting the selector into a window defined in a cap structure of the throttle release actuator while compressing the biasing assembly to enable the biasing assembly to fit within the window. The window may enable rotation of the selector about an axis defined by the shaft to the throttle positions. The method may further include an operation of attaching the cap structure to the support assembly.

Some example embodiments may provide an operator of an outdoor power tool with improved ability to return of the tool to an idle state while operating the tool. Thus, for example, during operation in a state other than the idle state, if the operator should for any reason desire or need to return to the idle state, the return may be conducted without manual interaction between the operator and the selector.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 illustrates a perspective view of a blower

Figure 2B:
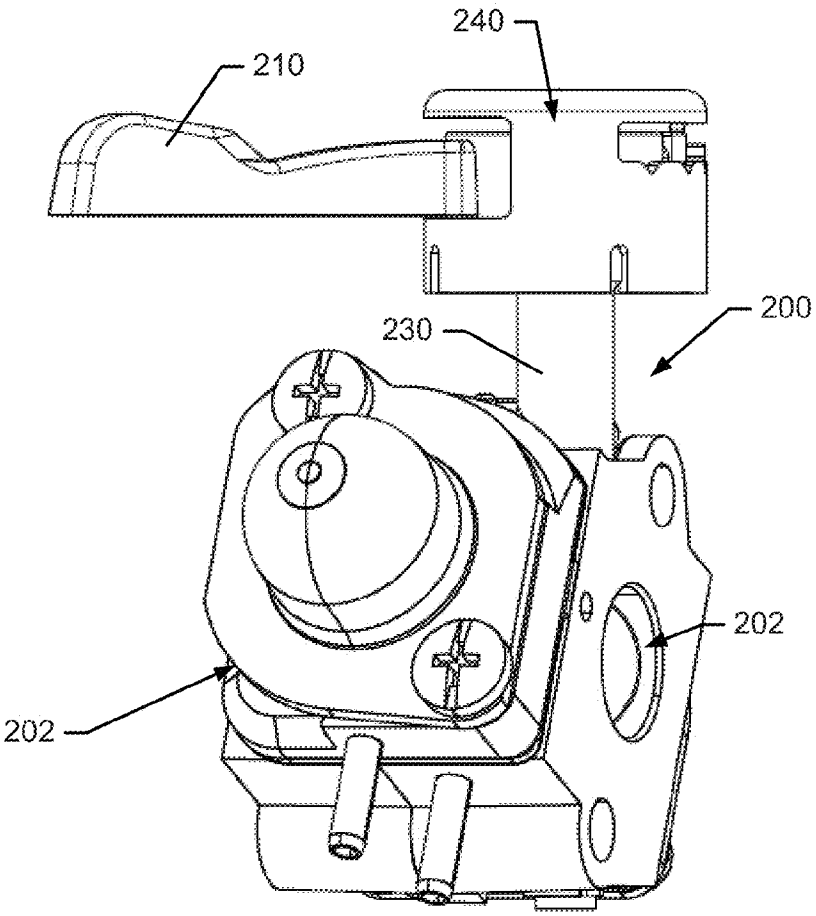
Figure 2A:
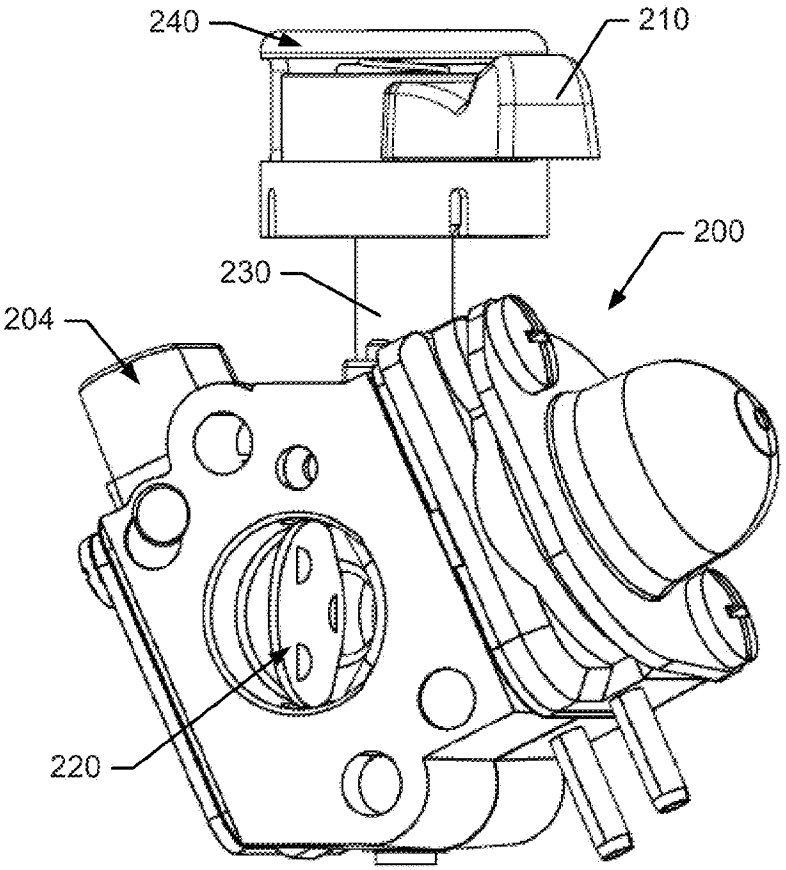
Figure 3B:
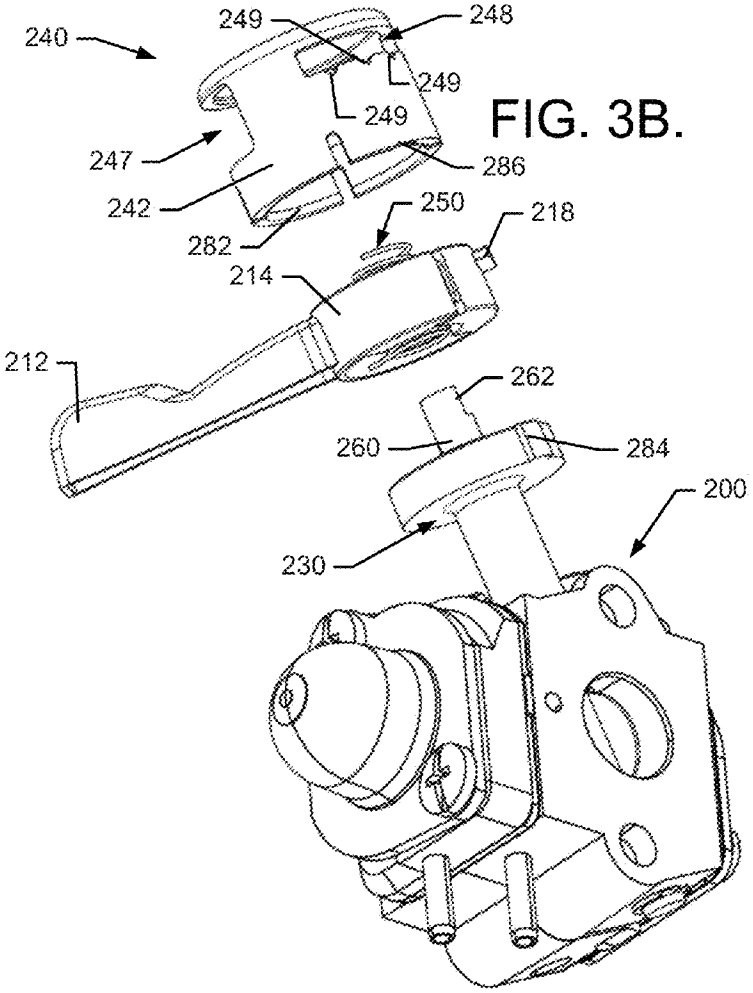
Figure 3A:
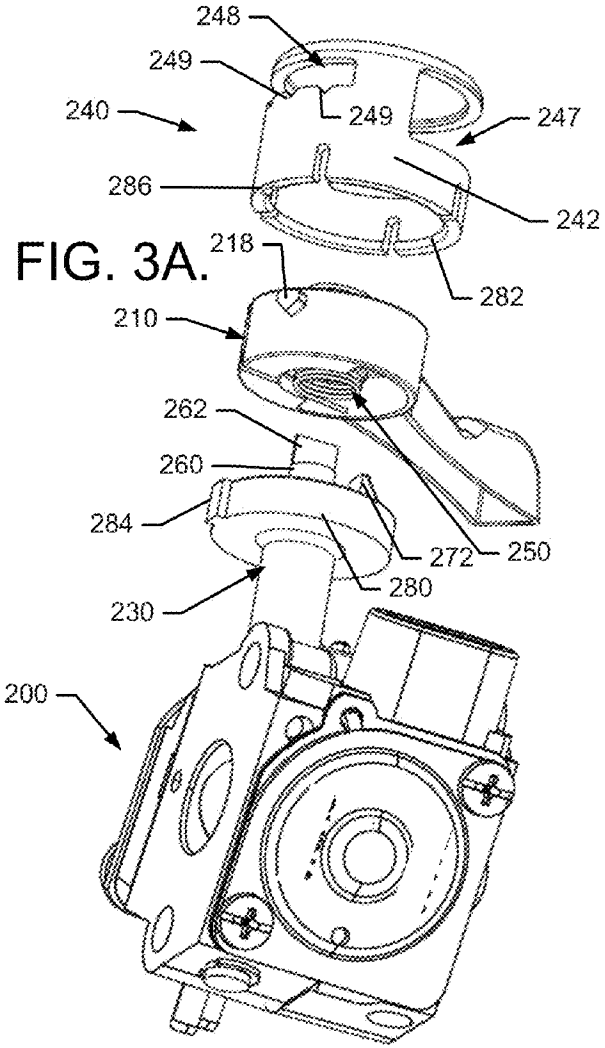
Figure 4A:
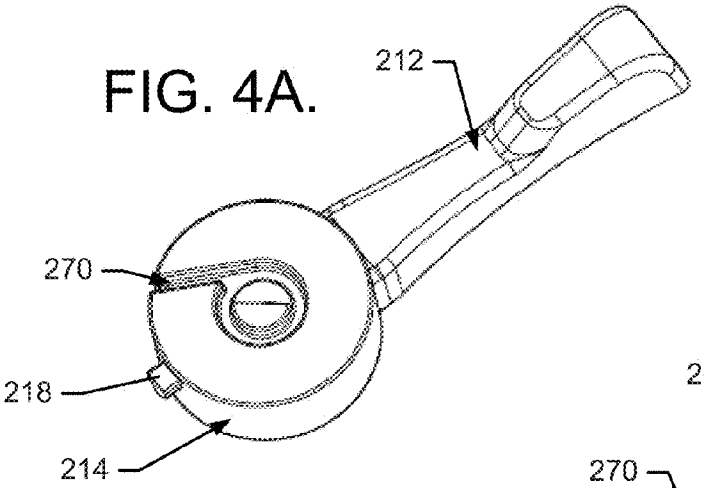
Figure 4B:
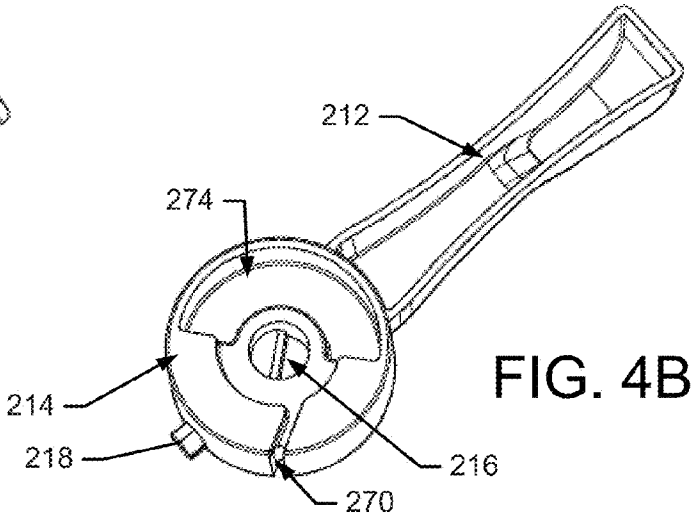
Figure 4C:
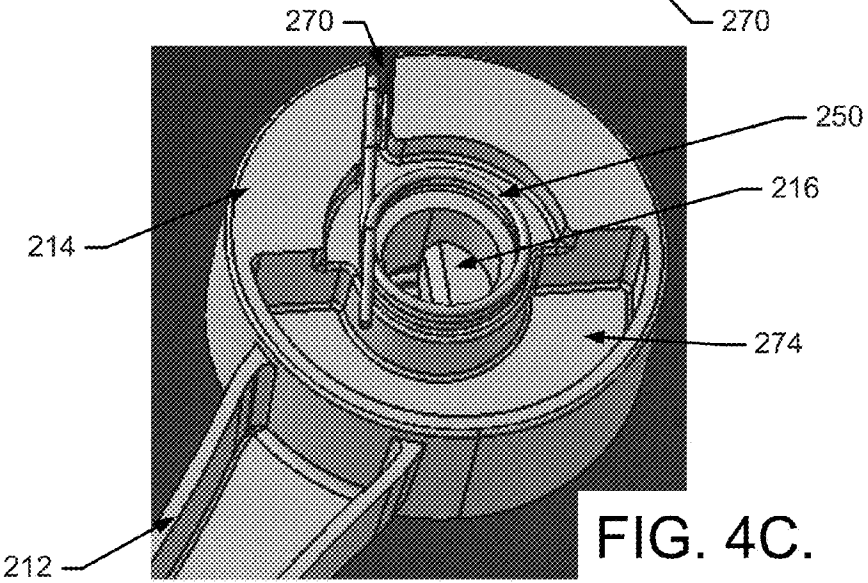
Figure 5:
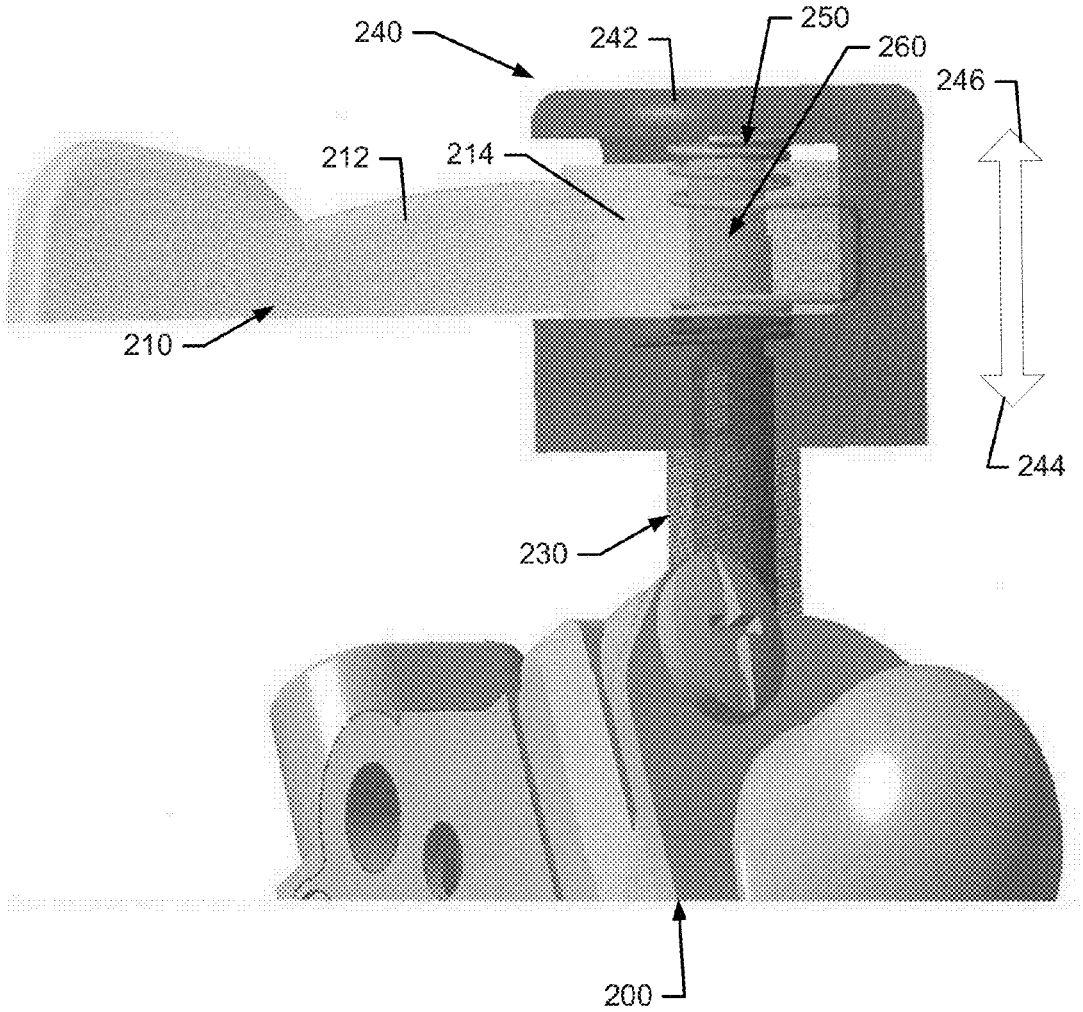
Figure 6:
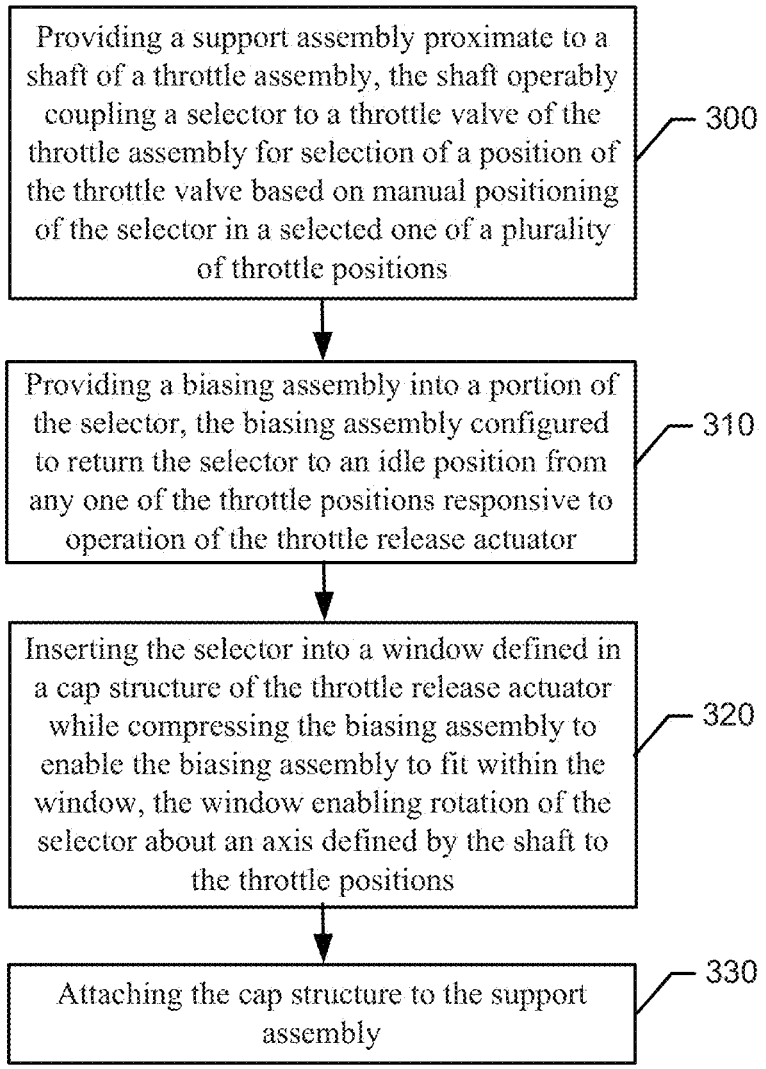

FIG. 2, which includes FIGS. 2A and 2B, shows respective different perspective views of a carburetor with a throttle release actuator that may be employed in outdoor power equipment in accordance with an example embodiment;

FIG. 3, which includes FIGS. 3A and 3B, shows respective different exploded perspective views of the throttle release actuator in accordance with an example embodiment;

FIG. 4, which includes FIGS. 4A, 4B and 4C, illustrates a top perspective view, a bottom perspective view, and a bottom perspective view with a biasing element installed of a selector of an example embodiment;

FIG. 5 illustrates a side view of the selector and throttle release actuator of one example embodiment in which the throttle release actuator and selector are meant to be transparent to reveal the biasing element in situ according to an example embodiment; and FIG. 6 is a block diagram of a method of assembling a throttle release actuator in accordance with an example embodiment.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Some example embodiments described herein provide a throttle release actuator that is usable with any of a variety of devices that are examples of outdoor power equipment. In particular, some embodiments may form a throttle release assembly that is configured to enable a user to easily return the engine to an idle state. In this regard, a lever or selector may be provided that is enabled to be manually moved to any one of a number of selectable throttle positions. However, the operator may be further enabled to trigger an automatic return to the idle position from any one of the selectable throttle positions via actuation of the throttle release actuator.

FIG. 1 illustrates a perspective view of a blower 100. It should be appreciated that the blower 100 of FIG. 1 merely represents one example of power equipment on which an example embodiment may be employed. Thus, alternative embodiments may also be employed on other devices such as, for example, trimmers, edgers and/or the like. The blower 100 is therefore only presented as one, non-limiting example for which some of the functionality achievable by example embodiments will be described.

Referring to FIG. 1, the blower 100 may include a housing 110 inside which a power unit or engine 120 is housed. In some embodiments, the power unit may be an internal combustion engine employing a carburetor. The blower 100 may further include a blower tube 130 that is attached to housing 110 and through which air may be expelled. The operation of the engine 120 may cause an impeller (not shown) to rotate so that air can be drawn into the blower 100 and expelled from the blower tube 130 to blow leaves, debris, or any other desirable material. The blower 100 may further include a selector 140 that may be operably coupled to a throttle valve that controls the provision of air through the carburetor.

In an example embodiment, the selector 140 may be a lever, switch, or other member that is provided to be selectable between a plurality of different positions. In a typical embodiment, the selector 140 must be manually moved by the operator to each and every one of the selectable different positions in order to affect the selection of a corresponding one of those different positions. In other words, there is no mechanism provided to move from any one of those positions to another of those positions without the operator physically handling the selector 140 to move the selector and cause the corresponding different position to be selected. Thus, for example, if an operator is operating in a selected one of the different positions, there is no way to return to an idle state unless the operator manipulates the selector to the idle state.

However, in accordance with an example embodiment, return to the idle state may be accomplished from any one of the selected positions automatically responsive to the operator triggering operation of a throttle release actuator according to an example embodiment. As such, for example, after the operator actuates the throttle release actuator, regardless of the position in which the selector 140 is initially fixed, the selector 140 will be returned to the idle position so that the engine 120 returns to the idle state without requiring the operator to operate (or in some cases even touch) the selector 140. FIGS. 2 to 5 illustrate one example of how the throttle release actuator of one example embodiment may be provided.

FIG. 2, which includes FIGS. 2A and 2B, shows respective different perspective views of a carburetor 200 with a throttle release actuator 240 that may be employed in the blower 100 or some other device. FIG. 3, which includes FIGS. 3A and 3B, shows respective different exploded perspective views of the throttle release actuator 240 in accordance with an example embodiment. FIG. 4, which includes FIGS. 4A, 4B and 4C, illustrates a top perspective view, a bottom perspective view, and a bottom perspective view with biasing element installed of the selector 210 of an example embodiment. FIG. 5 illustrates a side view of the selector and throttle release actuator of one example embodiment in which the throttle release actuator and selector are meant to be transparent to reveal the biasing element in situ according to an example embodiment.

An example embodiment will now be described in reference to FIGS. 2 to 5. As is conventionally known, air and fuel are mixed in the carburetor 200 for provision to the engine 120 for combustion therein. Air may be provided via an air inlet 202 and the fuel may be provided via a fuel inlet 204. A venturi may be provided at an interior of the carburetor 200 to draw fuel into the carburetor 200 for mixing with the air. A selector 210 of an example embodiment may be provided to be operably coupled to a throttle assembly. The throttle assembly may include a rotatable shaft that is operably coupled to a throttle valve 220 and the selector 210. In FIG. 2, the rotatable shaft is not visible, but is located within a support assembly 230 that is fixed to a portion of the carburetor 200 (and is labeled as shaft 260 in FIGS. 3 and 5).

Based on the positioning of the selector 210, the throttle valve 220 may be positioned and a corresponding amount of air may be provided through the carburetor 200. As the amount of air is allowed to increase, more fuel will be drawn into the mixture and passed into the engine 120. When the selector 210 is in an idle position, a relatively low amount of air may be permitted to pass by the throttle valve 220 and the engine 120 may operate in an idle state. As the selector 210 is moved to subsequent other operating positions, which may correlate to distinct or discrete different positions of the selector 210, the throttle valve 220 is opened further and increased air flow is permitted (which draws correspondingly increased fuel into the carburetor 200).

According to an example embodiment, the selector 210 may be automatically returned (i.e., returned without the operator having to manually grasp and reposition the selector 210) by operation of a throttle release actuator 240. The throttle release actuator 240 may be an assembly that is defined by a cap structure 242 that has a rest position and a depressed position, and a biasing assembly 250 that is configured to work with the cap structure 242, the selector 210 and/or the support assembly 230 to perform the automatic return of the selector 210 in accordance with an example embodiment. In the rest position, which is shown in the example of FIG. 5, the cap structure 242 may be in its normal position and may be held in such position by the biasing assembly 250 (in connection with structural elements of the cap structure and support assembly 230 as described in greater detail below). The biasing assembly 250 of an example embodiment may have dual functionality of biasing the cap structure 242 toward the normal position and biasing the selector 210 toward the idle position. When deflected or otherwise moved out of the positions toward which the biasing assembly 250 is biased, corresponding components may overcome the biasing force of the biasing assembly 250 to enable the cap structure 242 and the selector 210 to be respectively moved out of the normal positions toward which they are biased (i.e., the rest position and the idle position, respectively). Thus, for example, when the cap structure 242 is depressed to actuate the throttle release actuator 240, the cap structure is moved downward (as shown by arrow 244) and the biasing assembly 250 is charged or loaded to enable the biasing assembly 250 to unload or discharge (moving in the direction shown by arrow 246) to return the cap structure 242 to its rest position after the cap structure 242 is no longer depressed. Similarly, as will be described in greater detail below, when the selector 210 is moved to overcome the force of the biasing assembly 250 that tends toward returning the selector 210 to the idle position, the biasing assembly 250 may be charged or loaded to enable the biasing assembly 250 to unload or discharge and return the selector 210 to the idle position when (as will be discussed in greater detail below) the cap structure 242 is in the depressed state.

In an example embodiment, the selector 210 may be provided with a lever arm 212 and a main body 214. The main body 214 may be substantially cylindrical in shape with a diameter of the main body 214 being slightly less than an inner diameter of the cap structure 242 so that the cap structure 242 is enabled to receive the main body 214 therein. The main body 214 may also have one or more structures provided therein to facilitate housing and/or operation of the biasing assembly 250 and also to facilitate reception of the shaft 260 to which the throttle valve 220 may be operably coupled. In an example embodiment, the main body 214 may include a reception slot 216 that is shaped to receive a key portion 262 disposed at a distal end of the shaft 260. The reception slot 216 may engage the key portion 262 such that rotation of the lever arm 212 causes the main body 214 to rotate about an axis defined by the shaft 260 and also causes the shaft 260 to rotate accordingly. It should also be appreciated that a slot could be provided on the shaft 260 and a corresponding keying structure could be provided on the main body 214 in some alternative embodiments.

The cap structure 242 of some embodiments may include a substantially continuous top portion having a circular shape. This top portion may form a "button" that can be depressed by the operator. The cap structure 242 may also have a substantially cylindrical shape formed by sidewalls that extend from circumferential edges of the top portion. In some embodiments, these sidewalls may have openings formed therein. For example, the cap structure 242 of an example embodiment may include a first window 247 and a second window 248. The first window 247 may receive the main body 214 during assembly such that the lever arm 212 passes through the first window 247 and enables the main body 214 to rotate about the axis defined by the shaft 260 when the lever arm 212 is grasped and moved by the operator. In some cases, a protrusion 218 may extend radially outwardly from a sidewall of the main body 214 out the second window 248. Although not required, the sidewall from which the protrusion 218 extends may be a sidewall that is substantially opposite to the sidewall from which the lever arm 212 extends. The protrusion 218 may be configured or shaped to facilitate engagement with a selected one of various reception slots 249 defined in the second window 248 of the cap structure 242.

During operation, the operator may rotate the lever arm 212 and the protrusion 218 may ride along a surface of the second window 249 to a selected one of the reception slots 249. As indicated above, the movement of the lever arm 212 away from the idle position may charge the biasing assembly 250. However, when the protrusion 218 is allowed to settle into one of the reception slots 249, the mechanics of the engagement therebetween (and/or the friction associated with the engagement) may be sufficient to prevent the biasing assembly 250 from returning the selector 210 to the idle position. However, if the cap structure 242 is pushed in the direction shown by arrow 244, the protrusion 218 may be lifted out of the respective one of the reception slots 249 so that the biasing assembly 250 is free to act upon the selector 210 to return it to the idle position.

It should be noted that the examples of FIGS. 2 to 5 are merely illustrative of one way to implement an example embodiment. Thus, for example, in some embodiments, the cap structure 242 may carry a protrusion, and a plurality of discrete slots, detents or catches may be provided on the main body 214 to accomplish similar functionality. Moreover, in some alternatives there need not necessarily be a plurality of discrete reception slots, catches or detents to define corresponding specific throttle positions. Instead, the plurality of positions at which the selector 210 may be held away from the idle position may be non-discrete locations. In such an embodiment, the friction between the cap structure 242 and the main body 214 may be sufficiently provided (by any means) to prevent the biasing assembly 250 from overcoming the friction and returning the selector 210 to the idle position except when the cap structure 242 is depressed.

In an example embodiment, the biasing assembly 250, as indicated above, may have dual functions of providing for restoration of the cap structure 242 to the rest position after it is depressed and restoration of the selector 210 to the idle position responsive to depression of the cap structure 242 (i.e., actuation of the throttle release actuator 240). The dual functions may, in some embodiments, be performed by separate and distinct components (i.e., separate biasing elements). For example, a torsion spring or the like may be provided to be supported by the shaft 260 and fixed at one end within the selector 210 and fixed at the opposite end by a portion of the support assembly 230 to handle return of the selector 210, while a compression spring or the like is provided to compress between the cap structure 242 and a portion of the support assembly 230 (or a portion of the shaft 260 or the selector 210) to return the cap structure 242 to the rest position after it has been depressed. However, in an example embodiment (such as is shown in FIGS. 2-5), the biasing assembly 250 may be provided as a single unitary biasing element that has a torsion portion and a compression portion to perform both of the functions described above.

In an example embodiment, the compression portion of the biasing assembly 250 may extend from the selector 210 to an interior portion of the cap structure 242 to push (e.g., in the direction of arrow 246) the cap structure 242 away from the selector 210. Meanwhile, the torsion portion may be provided such that the torsion portion extends around the shaft 260 and one end thereof is abutted against or held within a slot 270 within the main body 214 and the other end thereof is abutted against a post 272 of the support assembly 230. The post 272 may be proximate to the shaft 260 (although it need not be), and may extend away from a base portion of the support assembly 230 in an axial direction (e.g., a direction substantially parallel to the axis defined by the shaft 260). Accordingly, for example, as the selector 210 is moved by the operator, a channel 274 in the main body 214 of the selector 210 may accommodate or receive the post 272 over the range of motion of the selector 210. The selector 210 may then be held in a particular throttle position while the torsion portion is charged and ready to return the selector 210 to the idle position when the cap structure 242 is depressed to overcome the friction (or mechanical block) that prevents the selector 210 from returning to the idle position when the cap structure 242 is in the rest position.

Thus, for example, the compression portion may exert a linear force that is in the axial direction (substantially parallel to the axis defined by the shaft 260) in the direction shown by arrow 246. Meanwhile, the torsion portion may exert a rotary force that is in a second direction that is tangential to a radial direction (i.e., tangential to the circumference of the main body 214) where the radial direction is substantially parallel to a radius of the shaft 260. Although the torsion portion and compression portions of the examples pictured are provided by coil springs, it should be appreciated that other structures could alternatively be employed. For example, plastic or elastic materials having movable components that tend to resist movement and restore themselves in response to such movement may alternatively be employed in some cases. In an example embodiment, a living hinge may be employed for either or both of the compression portion or the torsion portion of the biasing assembly 250.

In some embodiments, the support assembly 230 may include a substantially cylindrically shaped selector receiver portion 280 onto or into which the cylindrical main body 214 of the selector 210 may be received. Sidewalls of the cap structure 242 may then extend along the selector receiver portion 280 (and in some cases also the main body 214) to encapsulate or enclose the main body portion 214 between the cap structure 242 and the selector receiver portion 280. In some embodiments, the cap structure 242 may have a lip 282 that can slide over a bottom edge of the selector receiver portion 280 and then engage the selector receiver portion 280 when the cap structure 242 is fully installed. The lip 282 may engage the bottom edge of the selector receiver portion 280 when the cap structure 242 is in the rest position, but may not engage the selector receiver portion 280 when the cap structure 242 is depressed.

In some cases, the selector receiver portion 280 may include a key structure 284 to hold the cap structure 242 in alignment with the selector receiver portion 280 via reception of the key structure 284 in a keying slot 286 disposed at an internal portion of the cap structure 242. Although not required, the keying slot 286 may be disposed on a same side of the cap structure 242 on which the second window 248 is located. It should also be appreciated that other keying structures could be employed, and the key portion and slot portion of such structures could be alternately placed on either of the two components being held together.

As indicated above, the lever arm 212 may extend through the first window 247. Accordingly, care must be taken to ensure proper assembly of the throttle release actuator. A method of assembling a throttle release actuator in accordance with an example embodiment is therefore also provided as shown in the block diagram of FIG. 6. The method may include providing a support assembly proximate to a shaft of a throttle assembly at operation 300. The shaft may operably couple a selector to a throttle valve of the throttle assembly for selection of a position of the throttle valve based on manual positioning of the selector in a selected one of a plurality of throttle positions. The method may further include providing a biasing assembly into a portion of the selector at operation 310. The biasing assembly may be configured to return the selector to an idle position from any one of the throttle positions responsive to operation of the throttle release actuator. The method may further include inserting the selector into a window defined in a cap structure of the throttle release actuator while compressing the biasing assembly to enable the biasing assembly to fit within the window at operation 320. The window may enable rotation of the selector about an axis defined by the shaft to the throttle positions. The method may also include attaching the cap structure to the support assembly at operation 330.

As can be appreciated from the description above, some embodiments may be enabled to provide improved control over outdoor power equipment that does not employ a trigger mechanism that automatically returns the engine to idle after release of the trigger. Thus, for example, even for machines with relatively simple controls, an improved amount of control over the operation of the machine can be provided to the user. Accordingly, some example embodiments may provide an ability to meet applicable operation standards or simply improve operator satisfaction with the control and operability of outdoor power equipment that is used or purchased.

According to an example embodiment, an outdoor power tool may be provided. The outdoor power tool may include an engine, a carburetor configured to provide a fuel and air mixture to the engine based on operation of a throttle assembly, a selector and a throttle release actuator. The selector may be operably coupled to the throttle assembly to control a position of the throttle assembly in a selected one of a plurality of throttle positions. One of the throttle positions may be an idle position and each of the other throttle positions may be selectable by an operator via manual positioning of the selector. The throttle release actuator may be configured to return the selector from any one of the throttle positions to the idle position responsive to operator actuation of the throttle release actuator.

The power tool of some embodiments may include additional features that may be optionally added either alone or in combination with each other. For example, in some embodiments, (1) the throttle release actuator may include a biasing assembly operably coupling the selector to a support assembly provided on the carburetor. The biasing assembly may be biased to return the selector to the idle position without operator contact with the selector. In some cases, (2) the biasing assembly may operate in a first direction to reset a position of the throttle release actuator responsive to actuation of the throttle release actuator and operate in a second direction to return the selector to the idle position responsive to actuation of the throttle release actuator. In an example embodiment, (3) the first direction is an axial direction and the second direction is tangential to a radial direction. In some embodiments, (4) the first direction is an axial direction and the second direction is tangential to a radial direction. In some cases, (5) the torsion portion and the compression portion are provided in a single unitary biasing element. In an example embodiment, (6) the torsion portion and compression portion are provided by separate springs. In some cases, (7) the throttle positions are discrete positions and the throttle release actuator may be defined by a cap structure into which the selector is provided. The cap structure may define a plurality of reception slots, each of which corresponds to one of the discrete positions. The selector may include a protrusion that is extendable into any one of the reception slots to define a reception slot into which the protrusion extends as the selected one of the throttle positions. In some embodiments, (8) the throttle positions are non-discrete positions and the throttle release actuator may be defined by a cap structure into which the selector is provided. The selector may include a protrusion that contacts the cap structure over a range of the non-discrete positions to define an intersection of the protrusion with the cap structure as the selected one of the throttle positions.

In some embodiments, any or all of the items (1) to (8) above may be provided individually or in combination with each other and the cap structure of the throttle release actuator may be depressed to actuate the throttle release actuator to enable movement of the protrusion from the selected one of the throttle positions to the idle position based on operation of a dual function biasing element that is biased both to return the selector to the idle position and return the throttle release actuator responsive to release of the throttle release actuator after the throttle release actuator is depressed. Additionally or alternatively, any or all of the items (1) to (8) above may be provided individually or in combination with each other and the cap structure may be enabled to move in an axial direction along an axis defined by a shaft of the throttle assembly that couples the selector to a throttle valve of the throttle assembly, but not to rotate about the axis. The selector may be enabled to rotate about the axis to each of the throttle positions, but not to move in the axial direction. Additionally or alternatively, any or all of the items (1) to (8) above may be provided individually or in combination with each other and the selector may be received in a first window of the cap structure and the reception slots or non-discrete positions are disposed in a second window of the cap structure. Additionally or alternatively, any or all of the items (1) to (8) above may be provided individually or in combination with each other and the selector may be provided with a biasing element that is compressed in an axial direction to enable the selector and the biasing element to be provided in the first window.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An outdoor power tool comprising:

an engine;

a carburetor configured to provide a fuel and air mixture to the engine based on operation of a throttle assembly, wherein air is provided through the carburetor by only a throttle valve of the throttle assembly;

a selector operably coupled to the throttle assembly to control a position of the throttle assembly in a selected one of a plurality of throttle positions, one of the throttle positions being an idle position and each of the other throttle positions being selectable by an operator via manual positioning of the selector, wherein the throttle assembly includes a rotatable shaft operably coupling the throttle valve to the selector, wherein based on the positioning of the selector, the throttle valve is positioned to provide a corresponding amount of air through the carburetor; and a throttle release actuator configured to enable the operator to return the engine to an idle state, wherein the throttle release actuator comprises a cap structure and a biasing assembly, the cap structure having a rest position and a depressed position, and wherein the biasing assembly works with the cap structure, the selector, or a support assembly to return the selector from any of the throttle positions to the idle position responsive to the cap structure being manually actuated by the operator into the depressed position.

2. The outdoor power tool of claim 1, wherein the biasing assembly operably couples the selector to the support assembly provided on the carburetor.

3. The outdoor power tool of claim 2, wherein the biasing assembly operates in a first direction to reset a position of the cap structure responsive to actuation of the cap structure and operates in a second direction to return the selector to the idle position responsive to actuation of the cap structure.

4. The outdoor power tool of claim 3, wherein the first direction is an axial direction and the second direction is tangential to a radial direction.

5. outdoor power tool of claim 3, wherein the biasing assembly comprises a torsion portion and a compression portion.

6. The outdoor power tool of claim 5, wherein the torsion portion and the compression portion are provided in a single unitary biasing element.

7. The outdoor power tool of claim 5, wherein the torsion portion and compression portion are provided by separate springs.

8. The outdoor power tool of claim 1, wherein the throttle positions are discrete positions and wherein the selector is provided in the cap structure, the cap structure defining a plurality of reception slots, each of which corresponds to one of the discrete positions, and wherein the selector comprises a protrusion that is extendable into any one of the reception slots to define a reception slot into which the protrusion extends as the selected one of the throttle positions.

9. The outdoor power tool of claim 8, wherein the cap structure of the throttle release actuator is depressed to enable movement of the protrusion from the selected one of the throttle positions to the idle position based on operation of the biasing assembly that is biased both to return the selector to the idle position and return the cap structure to the rest position responsive to release of the cap structure after the cap structure is depressed.

10. The outdoor power tool of claim 8, wherein the cap structure is enabled to move in an axial direction along an axis defined by the rotatable shaft of the throttle assembly that couples the selector to the throttle valve of the throttle assembly, but not to rotate about the axis, and wherein the selector is enabled to rotate about the axis to each of the throttle positions, but not to move in the axial direction.

11. The outdoor power tool of claim 8, wherein the selector is received in a first window of the cap structure and the reception slots or non-discrete positions are disposed in a second window of the cap structure.

12. The outdoor power tool of claim 8, wherein, during assembly, the selector is provided with the biasing assembly that is compressed in an axial direction to enable the selector and the biasing assembly to be provided in a first window.

13. The outdoor power tool of claim 1, wherein the throttle positions are non-discrete positions and wherein the selector is provided in the cap structure, and wherein the selector comprises a protrusion that contacts the cap structure over a range of the non-discrete positions to define an intersection of the protrusion with the cap structure as the selected one of the throttle positions.

14. The outdoor power tool of claim 13, wherein the cap structure of the throttle release actuator is depressed to enable movement of the protrusion from the selected one of the throttle positions to the idle position based on operation of the biasing assembly that is biased both to return the selector to the idle position and return the cap structure to the rest position responsive to release of the cap structure after the cap structure is depressed.

15. The outdoor power tool of claim 13, wherein the cap structure is enabled to move in an axial direction along an axis defined by the rotatable shaft of the throttle assembly that couples the selector to the throttle valve of the throttle assembly, but not to rotate about the axis, and wherein the selector is enabled to rotate about the axis to each of the throttle positions, but not to move in the axial direction.

16. The outdoor power tool of claim 13, wherein the selector is received in a first window of the cap structure and the reception slots or non-discrete positions are disposed in a second window of the cap structure.

17. The outdoor power tool of claim 13, wherein, during assembly, the selector is provided with the biasing assembly that is compressed in an axial direction to enable the selector and the biasing element to be provided in a first window.

18. A method of assembling a throttle release actuator for an engine with a carburetor, the carburetor configured to provide a fuel and air mixture to the engine based on operation of a throttle assembly, wherein air is provided through the carburetor by only a throttle valve of the throttle assembly, the method comprising:

providing a support assembly proximate to a shaft of the throttle assembly, wherein the throttle assembly includes a rotatable shaft and a selector, the rotatable shaft operably coupling the selector to the throttle valve of the throttle assembly for selection of a position of the throttle valve based on manual positioning of the selector in a selected one of a plurality of throttle positions;

providing a biasing assembly into a portion of the selector, the biasing assembly configured to return the selector to an idle position from any one of the throttle positions responsive to manual actuation of a cap structure of the throttle release actuator;

inserting the selector into a window defined in the cap structure of the throttle release actuator while compressing the biasing assembly to enable the biasing assembly to fit within the window, the window enabling rotation of the selector about an axis defined by the shaft to the throttle positions; and attaching the cap structure to the support assembly, wherein the cap structure has a rest position and a depressed position, wherein responsive to the cap structure being manually actuated by an operator into the depressed position, the biasing assembly returns the selector to the idle position from any one of the throttle positions.

19. The outdoor power tool of claim 1, wherein the outdoor power tool is a blower, trimmer, or edger.

20. A throttle release actuator configured to provide a fuel and air mixture to an engine for an outdoor power tool, wherein the engine is controlled by operation of a throttle assembly, the throttle assembly including a throttle valve, a rotatable shaft, and a selector, wherein air is provided through a carburetor to the engine by only the throttle valve of the throttle assembly, wherein the selector is operably coupled to the throttle assembly to control a position of the throttle assembly in a selected one of a plurality of throttle positions, one of the throttle positions being an idle position and each of the other throttle positions being selectable by an operator via manual positioning of the selector, wherein the throttle release actuator comprises a cap structure and a biasing assembly, the cap structure having a rest position and a depressed position, wherein the biasing assembly works with the cap structure, the selector, or a support assembly to return the selector from any one of the throttle positions to the idle position responsive to the cap structure being manually actuated by the operator into the depressed position.

* * * * *